US009482070B2

(12) United States Patent
Hartman et al.

(10) Patent No.: US 9,482,070 B2
(45) Date of Patent: Nov. 1, 2016

(54) METHOD AND SYSTEM FOR SEALING AN ANNULUS ENCLOSING A TUBULAR ELEMENT

(71) Applicant: SHELL OIL COMPANY, Houston, TX (US)

(72) Inventors: Stefan Aernout Hartman, Rijswijk (NL); Petrus Cornelis Kriesels, Rijswijk (NL); Dhivya Sashidhar, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 23 days.

(21) Appl. No.: 14/399,464

(22) PCT Filed: May 6, 2013

(86) PCT No.: PCT/EP2013/059360

§ 371 (c)(1),
(2) Date: Nov. 6, 2014

(87) PCT Pub. No.: WO2013/167520

PCT Pub. Date: Nov. 14, 2013

(65) Prior Publication Data

US 2015/0159467 A1 Jun. 11, 2015

(30) Foreign Application Priority Data

May 8, 2012 (EP) ..... 12167171

(51) Int. Cl.
*E21B 33/14* (2006.01)
*E21B 43/10* (2006.01)
(Continued)

(52) U.S. Cl.
CPC ..... *E21B 33/14* (2013.01); *E21B 7/20* (2013.01); *E21B 21/00* (2013.01); *E21B 34/06* (2013.01); *E21B 43/103* (2013.01)

(58) Field of Classification Search
CPC ..... E21B 33/14; E21B 34/06; E21B 21/00; E21B 7/20; E21B 43/103
See application file for complete search history.

(56) References Cited

U.S. PATENT DOCUMENTS 2,705,050 A * 3/1955 Davis ..... E21B 21/003 106/719
2,927,775 A * 3/1960 Hildebrandt ..... E21B 25/06 175/226

(Continued)

FOREIGN PATENT DOCUMENTS

GB 2436484 9/2007
WO 2005024178 A1 3/2005

(Continued)

OTHER PUBLICATIONS

PCT International Search Report, Application No. PCT/EP2013/059360 dated Jun. 18, 2013.

*Primary Examiner* — Zakiya W Bates
*Assistant Examiner* — Crystal J Miller

(57) ABSTRACT

The invention provides a method and a system for sealing an annulus enclosing a tubular element in a wellbore. The method comprises the steps of introducing a first drilling fluid in the wellbore; drilling an open hole section of the wellbore using a drilling tool suspended at the end of a drill string; replacing the drilling fluid with a sealing fluid; extending the tubular element into the open hole section of the wellbore; and flushing part of the sealing fluid out of the wellbore, leaving an annulus between the tubular element and a wellbore wall filled with a layer of sealing fluid. The aforementioned steps may be repeated as required.

14 Claims, 10 Drawing Sheets

(51) Int. Cl.

| | |
|---|---|
| ***E21B 7/20*** | (2006.01) |
| ***E21B 21/00*** | (2006.01) |
| ***E21B 34/06*** | (2006.01) |

(56) References Cited

U.S. PATENT DOCUMENTS 3,674,100 A * 7/1972 Becker ..... E21B 7/20 175/135
3,750,768 A * 8/1973 Suman, Jr. ..... E21B 21/003 166/295
4,602,974 A * 7/1986 Wood ..... B29C 63/36 118/408
4,791,998 A * 12/1988 Hempkins ..... E21B 21/00 175/61
5,169,264 A * 12/1992 Kimura ..... E21B 7/201 175/62
5,295,543 A * 3/1994 Terry ..... C04B 24/16 106/708
5,327,968 A * 7/1994 Onan ..... C04B 24/16 106/796
5,370,185 A * 12/1994 Cowan ..... C04B 28/04 166/293
5,853,049 A * 12/1998 Keller ..... B29C 63/36 156/287
5,866,517 A * 2/1999 Carpenter ..... C09K 8/424 166/291
5,874,387 A * 2/1999 Carpenter ..... C04B 24/163 507/219
5,896,927 A * 4/1999 Roth ..... E21B 33/13 166/285
6,702,021 B1 * 3/2004 Nguyen ..... C09K 8/12 166/293
7,387,174 B2 * 6/2008 Lurie ..... E21B 7/20 175/171
7,654,324 B2 * 2/2010 Chase ..... E21B 33/14 166/177.4
7,789,148 B2 * 9/2010 Rayssiguier ..... E21B 33/13 166/177.4
7,946,349 B2 * 5/2011 Kriesels ..... E21B 43/103 166/384
8,056,641 B2 * 11/2011 Kriesels ..... E21B 7/20 166/207
8,056,642 B2 * 11/2011 Kriesels ..... E21B 43/103 166/384
8,141,647 B2 * 3/2012 Kriesels ..... E21B 43/105 166/207
8,162,047 B2 * 4/2012 Chase ..... E21B 33/14 166/177.4
8,430,159 B2 * 4/2013 Van Nieuwkoop ... E21B 43/103 166/242.2
8,479,843 B2 * 7/2013 Kriesels ..... E21B 7/20 166/206
8,555,987 B2 * 10/2013 Kriesels ..... E21B 7/20 166/207
2007/0017669 A1 * 1/2007 Lurie ..... E21B 7/20 166/177.4
2009/0020285 A1 * 1/2009 Chase ..... E21B 33/14 166/285
2009/0032257 A1 * 2/2009 Rayssiguier ..... E21B 33/13 166/287
2009/0255689 A1 * 10/2009 Kriesels ..... E21B 43/105 166/384
2009/0288842 A1 * 11/2009 Kriesels ..... E21B 43/103 166/384
2010/0051277 A1 * 3/2010 Chase ..... E21B 33/14 166/293
2010/0089593 A1 * 4/2010 Hou ..... F16L 55/1651 166/384
2010/0252333 A1 * 10/2010 Blange ..... E21B 43/103 175/424
2010/0270037 A1 * 10/2010 Kriesels ..... E21B 7/20 166/384
2010/0276202 A1 * 11/2010 Kriesels ..... E21B 43/103 175/61
2010/0294487 A1 * 11/2010 Kriesels ..... E21B 43/103 166/207
2010/0331959 A1 * 12/2010 Kriesels ..... E21B 43/103 623/1.15
2014/0131053 A1 * 5/2014 Kriesels ..... E21B 43/103 166/384

FOREIGN PATENT DOCUMENTS

WO 2008006841 A1 1/2008
WO 2009056514 A1 5/2009
WO 2009074643 A2 6/2009

* cited by examiner

METHOD AND SYSTEM FOR SEALING AN ANNULUS ENCLOSING A TUBULAR ELEMENT

PRIORITY CLAIM

The present application is a National Stage (§371) application of PCT/EP2013/059360, filed May 6, 2013, which claims priority from European Application 12167171.3, filed May 8, 2012, each of which are hereby incorporated by reference in their entirety.

The present invention relates to a method and system for sealing an annulus enclosing a tubular element in a wellbore. The system and method can be applied for the cementing of a liner in a wellbore.

The technology of radially expanding tubular elements finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall. Typically, a casing extends from surface into the wellbore and a liner extends from a certain depth further into the wellbore. However, in the present context, the terms "casing" and "liner" are used interchangeably and without such intended distinction.

In conventional wellbore construction, several casings are set at different depth intervals, and in a nested arrangement. Herein, each subsequent casing is lowered through the previous casing and therefore has a smaller diameter than the previous casing. As a result, the cross-sectional area of the wellbore that is available for oil and gas production decreases with depth.

To alleviate this drawback, it is possible to radially expand one or more tubular elements at a desired depth in the wellbore, for example to form an expanded casing, expanded liner, or a clad against an existing casing or liner. Also, it has been proposed to radially expand each subsequent casing to substantially the same diameter as the previous casing to form a monodiameter wellbore. It is thus achieved that the available diameter of the wellbore remains substantially constant along (a section of) its depth as opposed to the conventional nested arrangement.

WO-2008/006841 discloses a wellbore system for radially expanding a tubular element in a wellbore. The wall of the tubular element is induced to bend radially outward and in axially reverse direction so as to form an expanded section extending around an unexpanded section of the tubular element. The length of the expanded tubular section is increased by moving, for instance by forcing or pushing, the unexpanded section into the expanded section. Herein the expanded section retains the expanded tubular shape. At its top end, the unexpanded section can, for instance, be extended by adding pipe sections or by unreeling, folding and welding a sheet of material into a tubular shape.

When lining a wellbore using the system of WO-2008/006841, the annulus between the expanded tubular element and the wellbore wall will be relatively small in comparison to conventional casing systems. The expanded pipe section will be in close proximity to or even engage the wellbore wall. Consequently it is impossible to perform a conventional cementing job, which is typically used to establish zonal isolation when using conventional casings in a nested arrangement. Cementing job herein means the application of cement in the annulus enclosing a liner or casing.

In a conventional cementing job, a slurry for forming cement may be pumped downhole via the drill string and via the downhole end of the drill string, and subsequently uphole via the annulus between the casing or liner and the wellbore wall. Alternatively, the cement slurry may be pumped through the inner fluid passage of the casing while being contained between two cement plugs.

Due to the relatively small annulus between the inverted pipe and the well bore wall when using the system of WO-2008/006841, it would require a relatively high pressure difference to pump the cement slurry into the annulus. Also, pumping cement slurry into the small annulus may result in a non-uniform fill off the annulus. In addition, the everted pipe may engage the wellbore wall along at least a part of its length, so that the annulus may lack a continuous flow path from its downhole end to surface. When the inverted tubular has engaged the wellbore wall along a certain length and thereby established zonal isolation, circulating fluid or cement slurry through the annulus will be impossible.

WO-2009/074643 discloses a system for expanding a tubular element, similar to the system disclosed in WO-2008/006841. Herein, a conduit extends into the blind annulus between the expanded section and the unexpanded section of the tubular element. The conduit enables to replace a fluid arranged in said blind annulus with a replacement fluid.

The system of WO-2009/074643 however lacks any indication how to arrange cement in the annulus around the expanded tubular section, i.e. between the expanded tubular section and either the wellbore wall or another casing. An upper part of said annulus will have been zonally isolated, for instance with cement or because the expanded tubular section engages the wellbore wall and thus provides zonal isolation. The isolated upper part of the annulus will render it impossible to arrange a conduit in said annulus for replacing a fluid, or to pump cement slurry in a conventional manner. The same problem is described above with respect to the system of WO-2008/006841.

The present invention aims to overcome the problem described above.

The present invention therefore provides a method for sealing an annulus around an expanded section of an expandable tubular element enclosing a tool string, wherein a downhole end portion of a wall of the expandable tubular element is bent radially outward and in axially reverse direction defining the expanded tubular section extending around an unexpanded tubular section of the expandable tubular element, the method comprising the steps of:

i) introducing a first drilling fluid in the wellbore;

ii) drilling an open hole section of the wellbore using a drilling tool suspended at the end of the tool string;

iii) replacing the drilling fluid with a sealing fluid;

iv) extending the tubular element into the open hole section of the wellbore, by pushing the unexpanded section into the expanded tubular section;

v) flushing part of the sealing fluid out of the wellbore, leaving the annulus filled with a layer of sealing fluid.

The method of the present invention eliminates the need to circulate cement through the annulus. The method thus enables the use of cement in combination with a system for expanding a liner in a wellbore by everting said liner. Also, the method of the invention is suitable to cement a conventional casing, for instance in case the annular space between said casing and an enclosure would be too small to allow the pumping of a cement slurry or in case the pressure required to pump said cement slurry would exceed the maximum output pressure of available pumping equipment.

In an embodiment, the method comprises the step of:

vi) allowing said layer of sealing fluid to set during a setting time period.

In another embodiment, the method steps as described above may be repeated. Thus, the method enables to provide a liner along a predetermined section of the wellbore leaving a relatively small annular space between said liner and the wellbore wall, while ensuring zonal isolation by introducing a sealing fluid in the annulus.

By moving the unexpanded tubular section downward relative to the expanded tubular section, the tubular element is effectively turned inside out. The tubular element is progressively expanded without an expander that is pushed, pulled or pumped through the tubular element. The expanded tubular section can form a casing or liner in the wellbore. The expanded tubular liner may have a collapse resistance which is adequate to stabilize or support the wellbore wall.

It is preferred that the wall of the tubular element includes a material that is plastically deformed during expansion. The expanded tubular section will retain an expanded shape due to the plastic deformation, i.e. permanent deformation, of the wall of the expandable tubular element. There is no need to apply an external force or pressure to maintain the expanded tubular section in its expanded form. If, for example, the expanded tubular section engages the wellbore wall, no additional radial force or pressure needs to be exerted to keep the expanded tubular section against the wellbore wall.

The wall of the tubular element may comprise a metal such as steel or any other ductile material capable of being plastically deformed by eversion of the tubular element. The expanded tubular section preferably has adequate collapse resistance to support or stabilize the wellbore wall. Depending on the respective formation, the collapse resistance of the expanded tubular section may exceed, for example, 100 bar to 150 bar. The collapse resistance may be in the range of for instance 200 bar to about 1600 bar or more, for instance about 400 bar to 800 bar or more.

Suitably the bending zone is induced to move in axial direction relative to the remaining tubular section by inducing the remaining tubular section to move in axial direction relative to the expanded tubular section. For example, the expanded tubular section is axially fixed at some location, while the unexpanded tubular section is moved in axial direction through the expanded tubular section to induce said bending of the wall.

In order to induce said movement of the unexpanded tubular section, the unexpanded tubular section is subjected to an axially compressive force acting to induces said movement. The axially compressive force preferably results at least partly from the weight of the remaining tubular section. A pushing device may supplement the weight of the unexpanded tubular section by applying an additional external force to the remaining tubular section to induce said movement. Said pushing device may push the unexpanded section into the expanded section to extend the latter. The additional force applied by the pushing device may be upward or downward. For instance, as the length and hence the weight of the unexpanded tubular section increases, an upward force may need to be applied to the unexpanded tubular section to maintain the total force applied to the unexpanded section within a predetermined range. Maintaining the total force within said range will prevent uncontrolled bending or buckling of the bending zone.

If the bending zone is located at a lower end of the tubular element, whereby the remaining tubular section is axially shortened at a lower end thereof due to said movement of the bending zone, it is preferred that the remaining tubular section is axially extended at an upper end thereof in correspondence with said axial shortening at the lower end thereof. The remaining tubular section gradually shortens at its downhole end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to the upper end in any suitable manner such as by welding. Alternatively, the remaining tubular section can be provided as a coiled tubing which is unreeled from a reel and subsequently inserted into the wellbore.

Optionally the bending zone can be heated to promote bending of the tubular wall.

The invention will be described hereinafter in more detail and by way of example with reference to the accompanying drawings in which.

In the drawings and the description, like reference numerals relate to like components.

Figure 1:
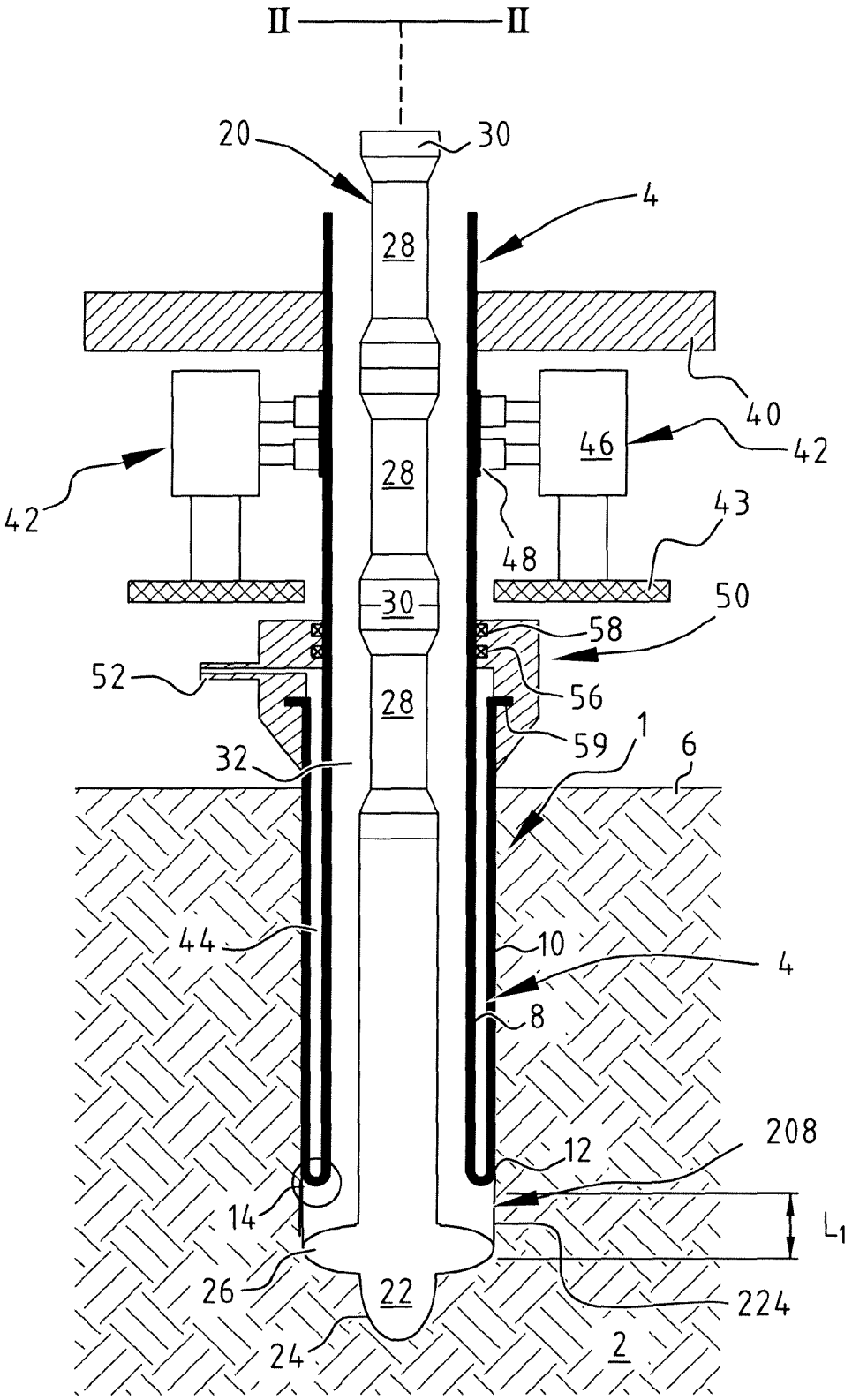
FIG. 1 shows a vertical cross section of a lower portion of a system for radially expanding a tubular element.

FIG. 1 shows a wellbore 1 formed in an earth formation 2. A radially expandable tubular element 4, for instance an expandable steel liner, extends from surface 6 down into the wellbore 1. The tubular element 4 comprises an unexpanded tubular section 8 and a radially expanded tubular section 10. The unexpanded section 8 extends within the expanded section 10. Preferably, an outer diameter of the expanded tubular section 10 is substantially equal to the diameter of the wellbore 1.

Although the wellbore shown in FIG. 1 extends vertically into the formation 2, the present invention is equally suitable for any other wellbore. For instance, the wellbore 1 may extend at least partially in horizontal direction. Herein below, upper end of the wellbore refers to the end at surface 6, and lower end refers to the end down hole.

At its lower end, the wall of the unexpanded section 8 bends radially outward and in axially reverse (in FIG. 1 the upward) direction so as to form a curved downhole section 12, defining a bending zone 14 of the tubular element 4. The curved section 12 is U-shaped in cross-section and interconnects the unexpanded section 8 and the expanded section 10.

A drill string 20 may extend from surface through the unexpanded liner section 8 to the lower end of the wellbore 1. The downhole end of the drill string 20 is provided with a drill bit 22. The drill bit comprises, for instance, a pilot bit 24 having an outer diameter which is slightly smaller than the internal diameter of the unexpanded liner section 8, and a reamer section 26 having an outer diameter adapted to drill the wellbore 1 to its nominal diameter. The reamer section 26 may be radially retractable to a smaller outer diameter, allowing it to pass through the unexpanded liner section 8, so that the drill bit 22 can be retrieved through the unexpanded liner section 8 to surface. The drill string 20 may comprise multiple drill pipe sections 28. The pipe sections 28 may be mutually connected at respective ends by male and female threaded connections 30. An annular space 32 between the drill string 20 and the unexpanded tubular section 8 is referred to as the drilling annulus 32.

The connections 30 are not shown in detail, but comprise for instance threaded, pin and box type connections. The connections 30 may comprise joints fabricated with male threads on each end, wherein short-length coupling members (not shown) with female threads are used to join the individual joints of drill string together, or joints with male threads on one end and female threads on the other. Said threaded connections may comprise connections which are standardized by the American Petroleum Institute (API).

FIG. 1 also shows a rig floor 40, which is elevated with respect to the surface 6 and encloses an upper end of the drill string 20 and of the unexpanded tubular section 8. The rig floor 40 is part of a drilling rig, which is however not shown in its entirety. A pipe pusher 42, which is for instance arranged below the rig floor, encloses the unexpanded section 8. The pipe pusher is for instance supported by base frame 43. The base frame 43 provides stability, and may for instance be connected to the drilling rig or be supported at surface 6. The pipe pusher may comprise one or more motors 46, which are arranged on the base frame, and one or more conveyer belts 48 which can be driven by the respective motors. Each conveyer belt 48 engages the outside of the unexpanded section 8. The conveyer belts 48 can exert force to said unexpanded section 8 to force the unexpanded section to move into the expanded section 10. Other embodiments of the pipe pusher 42 are conceivable, which will be able to exert downward or upward force to the unexpanded section.

A sealing device 50 can be connected to the upper end of the expanded liner section 10 to seal the unexpanded liner section 8 relative to the expanded liner section 10. Herein, the sealing device 50 enables the unexpanded liner section 8 to slide in axial direction relative to the sealing device 50. The sealing device comprises a conduit 52 which is connected to a pump (not shown) for pumping fluid into or out of a blind annulus 44, i.e. the annular space between the unexpanded liner section 8 and the expanded liner section 10. The annular space 44 is referred to as blind annulus as it is closed at the downhole end by the bending zone 14. The sealing device includes one, two or more annular seals 56, 58. The seals 56, 58 engage the outside of the unexpanded section 8 and prevent said fluid to exit the blind annulus. Preferably, the sealing device 50 comprises at least two seals 56, 58 to provide at least one additional seal to improve safety and reliability in case the first seal may fail.

The sealing device 50 can be regarded as a blind annulus blow out preventer (BABOP). Therefore, the seals 56, 58, the connection of the device 50 to the upper end of expanded section 10, and one or more valves (not shown) for closing conduit 52 will all be designed to at least withstand fluid pressures that may arise in a well control situation. Depending on specifics of the formation, the sealing device 50 is for instance designed to withstand pressures that may be expected in case of a blowout, for instance in the range of 200 bar to 1600 bar, for instance about 400 bar to 800 bar or more. Such pressures may for instance arise in the blind annulus 44 in case of a failure, for instance due to rupture, of the expandable tubular 4 in combination with a well control situation.

The expanded liner section 10 is axially fixed, by any suitable fixation means, to prevent axial movement. The expanded liner section 10 may be fixated at its upper end at surface. For instance, said upper end of the expanded section may be connected to a ring or flange 59, for instance by welding and/or screwing. Said ring can be attached to or incorporated in any suitable structure at surface, such as the sealing device 50. The inner diameter of said ring may be larger than the outer diameter of the expanded section. Optionally, the expanded section 10 may be fixed to the wellbore wall 224, for instance by virtue of frictional forces between the expanded liner section 10 and the wellbore wall 224 as a result of the expansion process. Alternatively, or in addition, the expanded liner section 10 can be anchored, for instance to the wellbore wall, by any suitable anchoring means.

Figure 2:
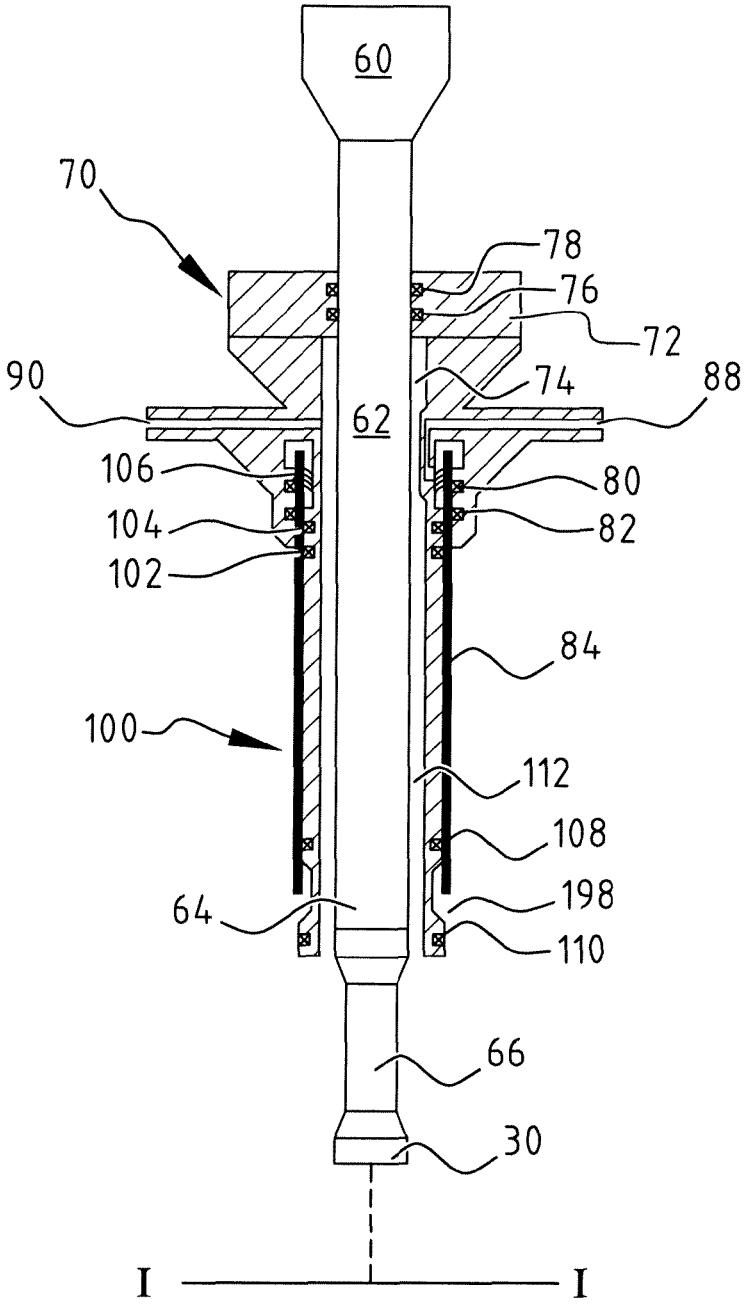
FIG. 2 shows a vertical cross section of an example of an upper portion of the system of FIG. 1.
Figure 3:
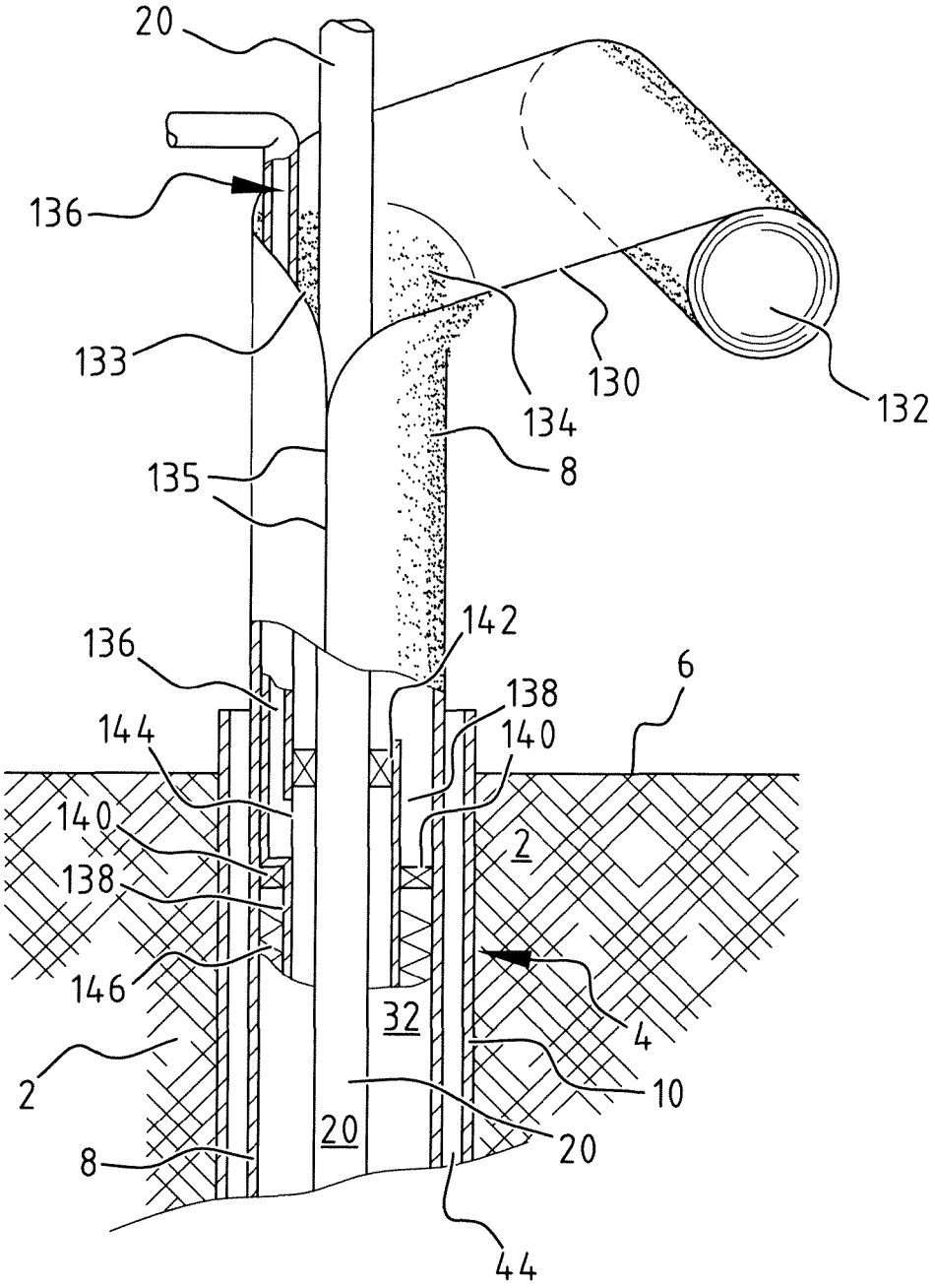
FIG. 3 shows a vertical cross section of another example of an upper portion of the system of FIG. 1.

At the interface indicated by the line II-II, the lower portion of the system shown in FIG. 1 can be connected to an upper portion as for instance shown in FIGS. 2 and 3.

FIG. 2 shows a top drive 60 connected to an upper end connection part 62, which is rotatable with respect to the top drive. Preferably, the upper end connection part comprises a flush pipe, having a smooth outer surface. A connection part end 64, which is remote from the top drive, is provided with a threaded connection 30 as described above. The threaded end 64 is connected to an additional drill string section 66. Typically, the additional drill string section 66 will be substantially equal to the drill string sections 28, shown in FIG. 1. At the interface indicated by line I-I, the additional drill pipe section 66 can be connected to the upper end of the drill string 20 shown in FIG. 1.

A drilling annulus sealing device 70 may cover the top end of the drilling annulus 32. The sealing device 70 comprises a housing 72, which encloses the connection part 62 and provides an internal space 74. At the top end, near the top drive 60, the housing may comprise one, two or more seals 76, 78, which engage the outside of the pipe 62. Preferably, the seals 76, 78 enable the housing to slide along the pipe 62. At the opposite end, the housing may comprise one, two or more seals 80, 82 which engage the outside of an additional expandable pipe section 84. In addition to the seals, the housing may comprise grippers 106, which may engage the outside and/or the inside of the pipe section 84. An activation line 88 is connected to the housing for activating or releasing the seals 80, 82 and/or the grippers 106. A fluid conduit 90 is connected to the internal space 74 for supply or drainage of (drilling) fluid to or from the annular space 32.

The sealing device 70 may comprise an extending part or stinger 100. The stinger extends into the inside of the additional expandable pipe section 84. The stinger may comprise seals 102, 104 and/or grippers 106 to engage the upper end of the pipe section 84. The stinger may also comprise seals 108 to engage a lower end of the pipe section 84, and seals 110 to engage the inside of the upper end of the unexpanded tubular section 8 (shown in FIG. 1). A backing gas tool 198 may be integrated in the stinger between the seals 108, 110. The backing gas tool covers the inner interface between the additional expandable pipe section 84 and the unexpanded tubular section 8.

The stinger may be at least slightly longer than the pipe section 84 so that the stinger may extend into the unexpanded section 8, which will enable the stinger to function as an alignment tool for aligning the pipe section 84 and the unexpanded section 8.

In practice, the length of the pipe section 84 may be in the range of about 5-20 meters, for instance about 10 meters. The stinger will for instance be about 2% to 10% longer, for instance 5% longer than the pipe section 84. An annular space 112 is provided between the stinger and the pipe 62 to provide a fluid connection from the annulus 32 to the space 74 and the conduit 90.

The sealing device 70 may be referred to as drilling annulus blow out preventer (DABOP) 70. The seals 76-82, the grippers 106, and one or more valves (not shown) for closing conduits 88 and 90 will all be designed to at least withstand fluid pressures that may arise in a well control situation. Depending on specifics of the formation and the expected maximum pore pressures, the DABOP 70 is for instance designed to withstand pressures in the range of about 200 bar to 800 bar or more, for instance about 400 bar.

The DABOP may comprise any number of seals. The DABOP 70 may comprise one seal 76 and one seal 80, or a plurality of seals. In a practical embodiment, two seals 76, 78 to seal with respect to the pipe 62 and two seals to seal with respect to the tubular section 84 will provide a balance between for instance fail-safety and reliability on one hand and costs on the other hand. For instance, the double barrier provided by the inner seals 102, 104, engaging the inside of the expandable pipe 84, and the outer seals 80, 82, engaging the outside of the expandable pipe 84, improves the reliability and leak-tightness of the sealing device 70.

FIG. 3 shows an upper portion of the system of FIG. 1. The unexpanded liner section 8 is at its upper end formed from a (metal) sheet 130 wound on a reel 132. The metal sheet 130 has opposite edges 133, 134. After unreeling from the reel 132, the metal sheet 130 is bent into a tubular shape and the edges 133, 134 are interconnected, for instance by welding, to form the unexpanded tubular section 8. Consequently, the expandable tubular element 4 may comprise a longitudinal weld 135.

A fluid conduit 136 extends from the interior of the unexpanded tubular section 8, to above the upper end of the unexpanded tubular section 8. The fluid conduit 136 may at its lower end be connected to, or integrally formed with, a tube 138 located in the unexpanded tubular section 8. A first annular seal 140 seals the tube 138 relative to the unexpanded liner section 8, and a second annular seal 142 seals the tube 138 relative to the drill string 20. The fluid conduit 136 is in fluid communication with the interior space of the tube 138 via an opening 144 provided in the wall of the tube 138. Furthermore the tube 138 is provided with gripper means 146 allowing upward sliding, and preventing downward sliding, of the tube 138 relative to the unexpanded liner section 8. The first annular seal 140 allows upward sliding of the tube 138 relative to the unexpanded liner section 8.

The upper portion shown in FIG. 3 can be combined with a lower portion shown in FIG. 1, wherein the unexpanded tubular section 8 is however continuously formed around the drill string 20. Herein, some of the features shown in FIG. 1 are omitted in FIG. 3 to improve the clarity of the latter figure, such as the sealing device 50, the pipe pusher 42 and drilling floor 40.

The method of cementing a liner according to the present invention is described herein below in subsequent steps. The sequence of steps may be performed repeatedly to provide a lined and cemented wellbore.

Figure 4:
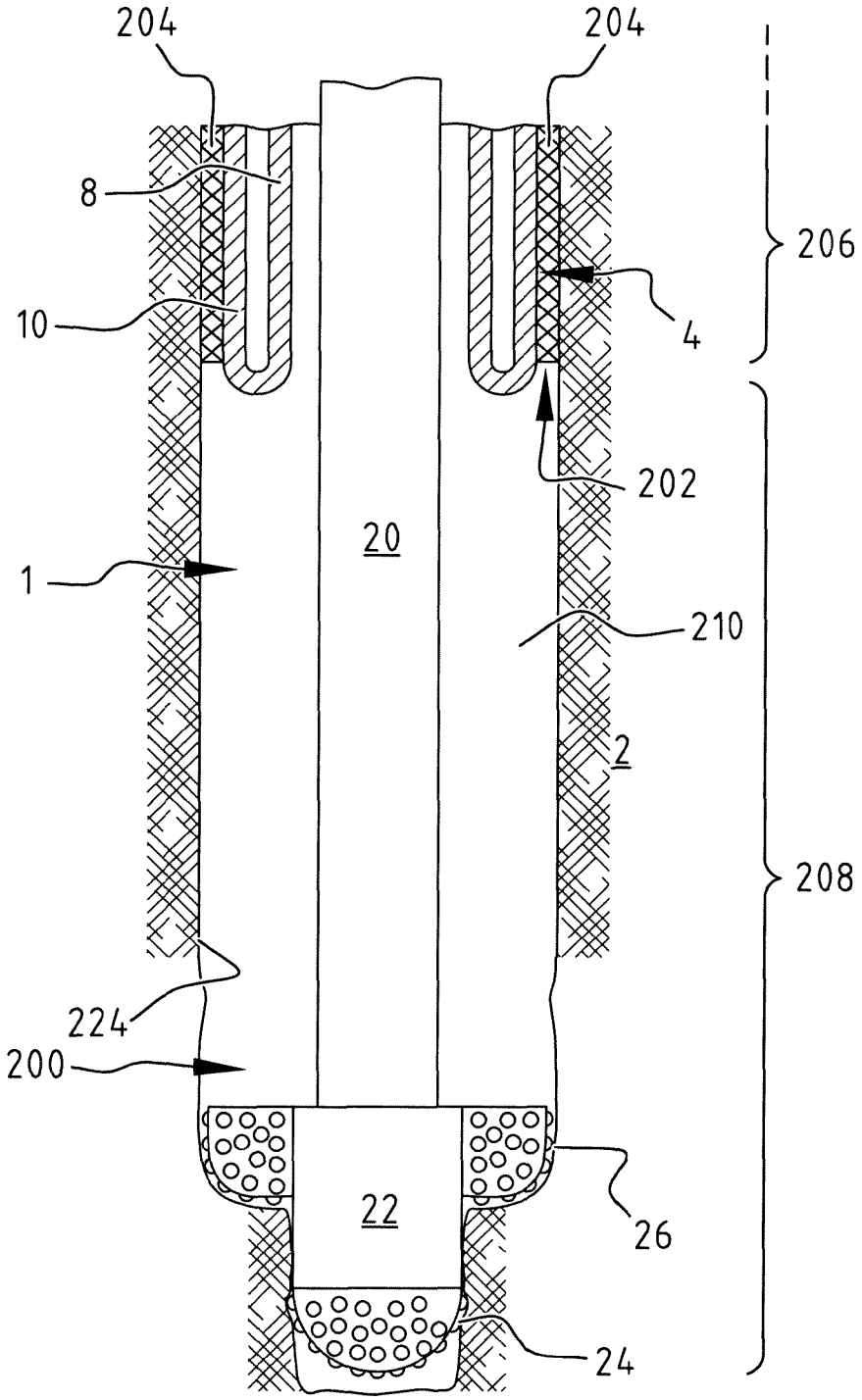
FIG. 4 shows a vertical cross section of a wellbore, indicating a first step in a method according to the invention.

FIG. 4 shows the wellbore 1 provided in earth formation 2. The wellbore is provided with expandable liner 4. The liner comprises unexpanded section 8 and radially expanded section 10. The expanded section 10 may be clad against the wellbore wall 224, or alternatively a relatively small annular space may remain therebetween along at least a section of the wellbore. The drill string 20 extends through the liner 4 and is provided with a drill bit 22 at its downhole end 200, near the bottom of the wellbore 1. The drill bit may comprise a pilot bit 24 and a reamer section 26.

An annulus 202 between the expanded section 10 and the wellbore wall 224 is provided with a layer a cement 204, providing a previously cemented section 206.

In a first step, starting from the previously sealed zone 206, drilling of the borehole is continued without further inverting the liner pipe 4, creating an open hole section 208. After reaming using the reamer 26, said open hole section 208 may have a diameter which is slightly larger the the outer diameter of the expanded liner section 10. Slightly larger herein for instance indicates a range of about 0.1 to 20 mm, typically a few millimeters or less. During drilling, the wellbore 1 including the open hole section 208 is filled with drilling fluid 210.

Figure 5:
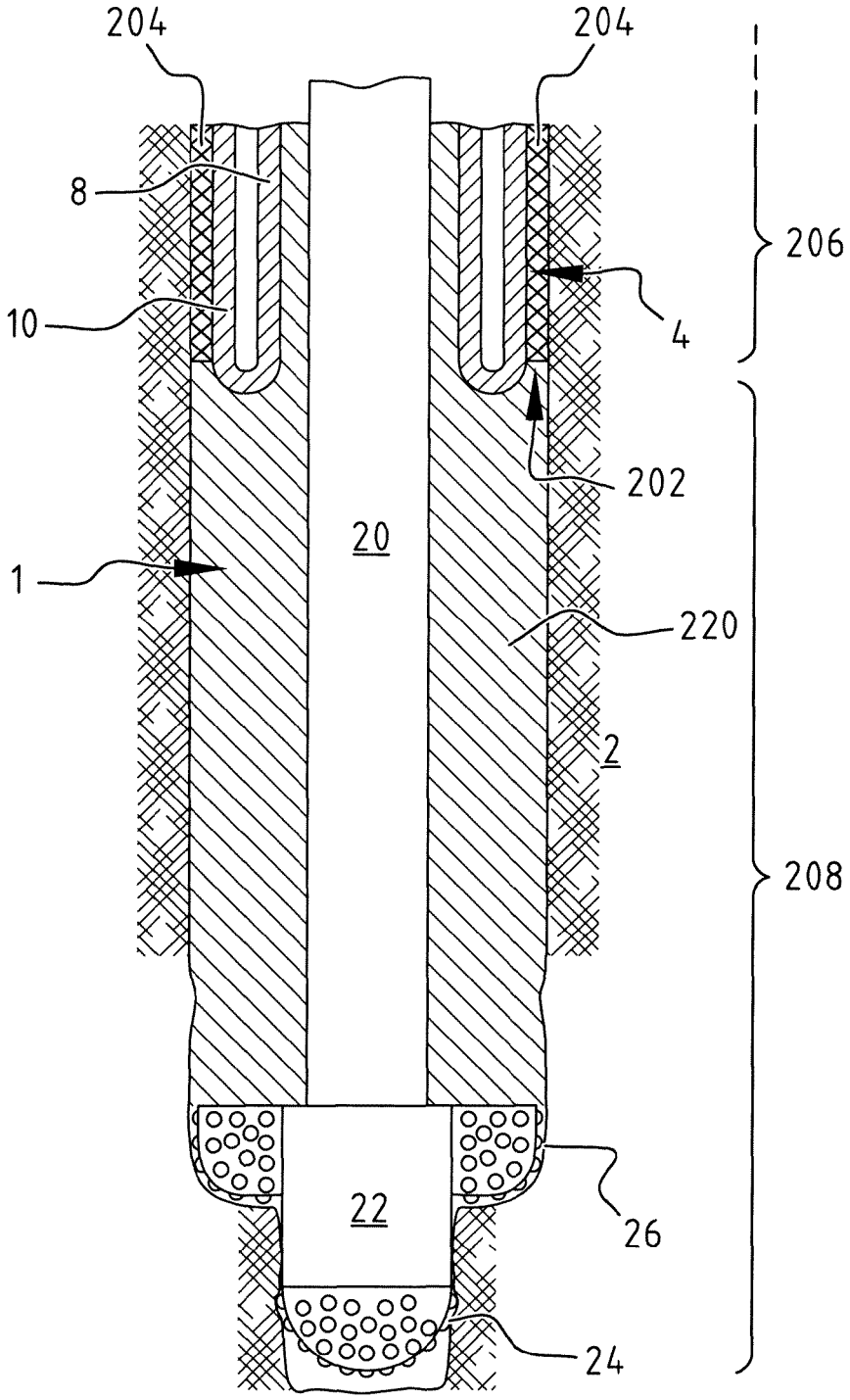
FIG. 5 shows a vertical cross section of a wellbore, indicating a second step in a method according to the invention.

In a second step (FIG. 5), the drilling fluid 210 in the wellbore 1 is replaced with a slurry of a sealing fluid 220. Basically, the wellbore including the open hole section 208 is filled with a bath of the sealing fluid 220.

Herein, the sealing fluid is intended to include any fluid or mixture of a fluid and one or more solid components that can have a sealing function in the annulus between the expanded pipe section and the bore hole wall 224. This sealing fluid may or may not be activated by time or by an external source.

Practical embodiments of such sealing fluid may include one or more of: cement, swellable elastomers, hardenable resins, mixtures of sand and clay, and drill cuttings. Hardenable resins that can be used include, but are not limited to: organic resins, such as bisphenol-A-diglycidyl-ether resins, butoxymethyl-butyl-glycidyl-ether resins, bisphenol-A-epichlorohydrin resins, bisphenol-F-resins, polyepoxide resins, novolak resins, polyester resins, phenol-aldehyde resins, urea-aldehyde resins, furan resins, urethane resins, glycidyl-ether resins, other epoxide resins, and combinations thereof. In an embodiment, the hardenable resin may include an elastomeric compound that may comprise an epoxy component, a poly-aspartic component, and/or a silicone rubber component.

Said slurry may set and harden within a predetermined setting time to form a durable solid material. An example thereof includes a cement slurry. Alternatively, the sealing fluid may remain flexible in time. An example may include certain types of epoxy or elastomers which swell when contacted with an activating fluid such as water or hydrocarbons.

Figure 6:
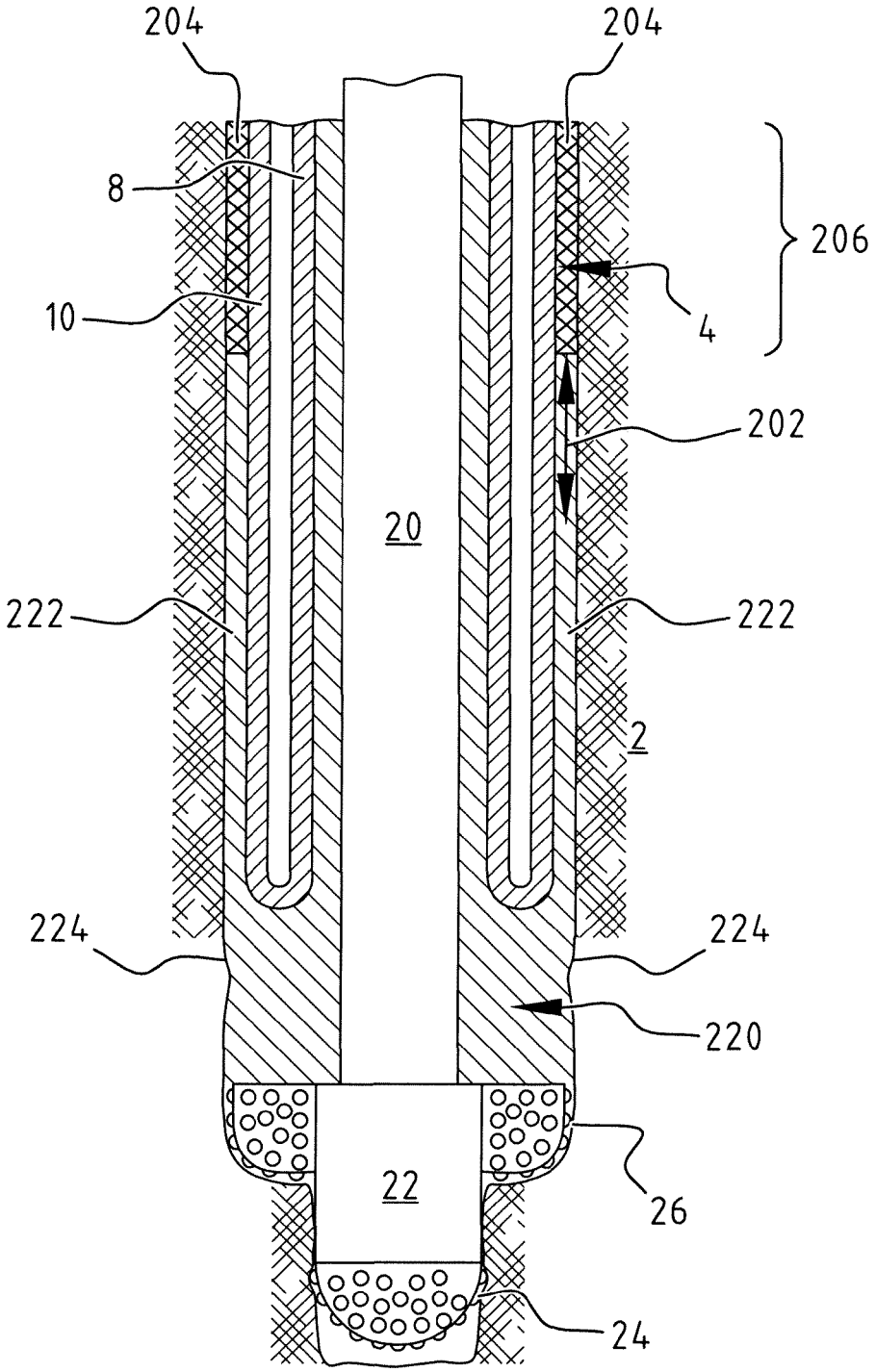
FIG. 6 shows a vertical cross section of a wellbore, indicating a third step in a method according to the invention.

In a third step (FIG. 6), the tubular member 4 is everted further, extending the expanded tubular section 10 into the bath of sealing fluid 220. During everting of the liner 4, a thin layer 222 of sealing fluid is created between the expanded tubular section 10 and the wellbore wall 224. Said thin layer may have a thickness comparable to the thickness of the annular space 202, for instance in the range of about 10 mm or less.

Figure 7:
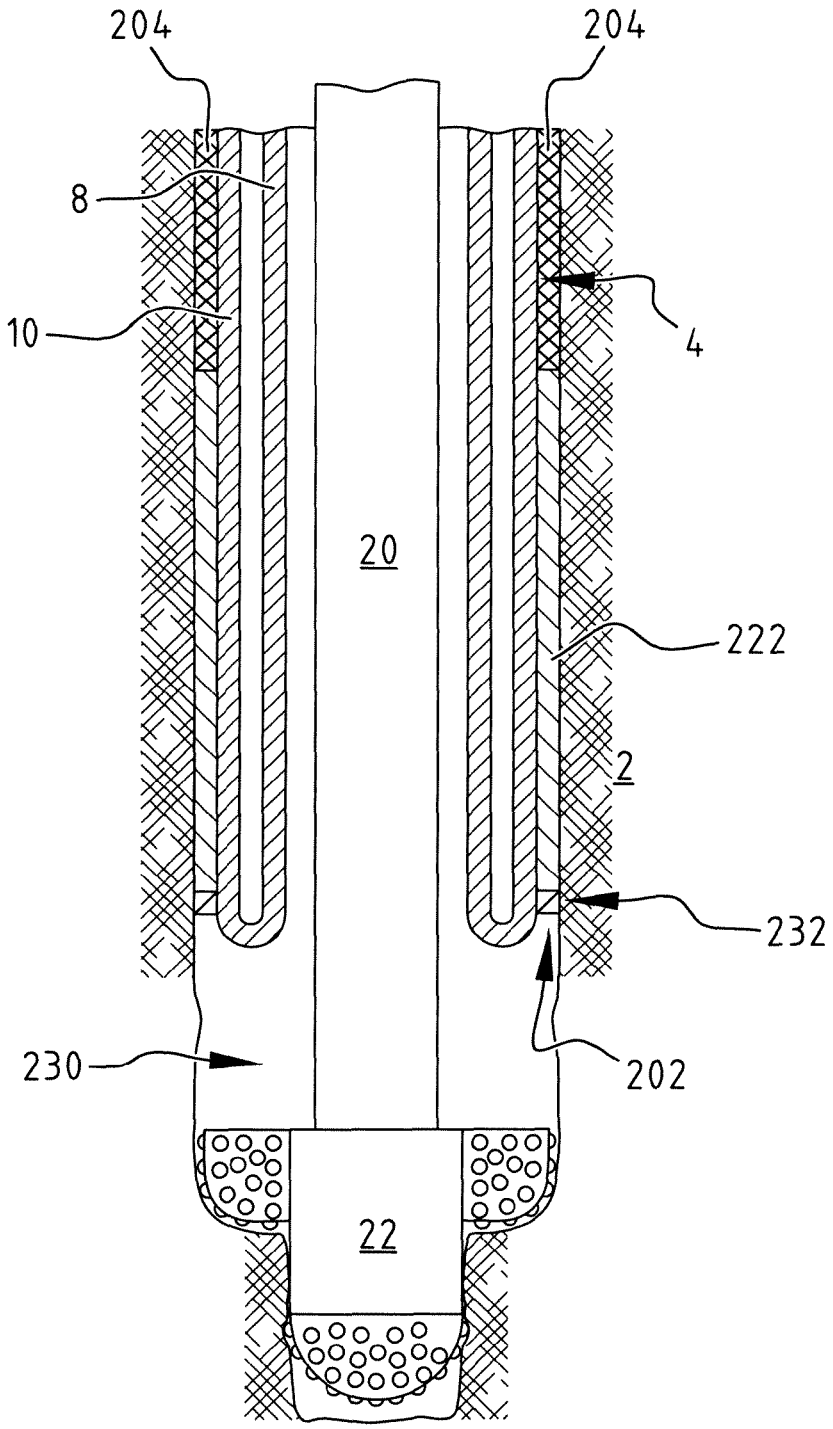
FIG. 7 shows a vertical cross section of a wellbore, indicating a fourth step in a method according to the invention.

In a subsequent step (FIG. 7), after the tubular element 4 has been everted and extends over a predetermined distance into the sealing fluid 220, excessive cement is removed by flushing, for instance using drilling fluid. To preserve the cement layer 222 and prevent said cement layer from leaking from the annulus 202 between the pipe and the wellbore wall, one or more of the following methods may be used:

1) Introduce a second, heavy and/or viscous drilling fluid 230 to replace the sealing fluid 220 and leave this fluid in place until the sealing fluid sheet 222 has set. Heavy herein preferably means having a specific weight, i.e. the weight per unit volume, exceeding the specific weight of the sealing fluid slurry 220. Said sealing fluid slurry may typically have a Specific Gravity (SG) in the range of about 0.1 to 10, depending on conditions and requirements of the particular wellbore. Viscous fluid herein may include a fluid having syrupy characteristics when untouched, and being able to flow when stirred or otherwise excited, for instance by movement of the drill string.

The heavy fluid may be introduced in the wellbore 1 while the drill bit 22 is located near the downhole end of the wellbore. Subsequently, the sealing fluid 220 is flushed out, until said heavy fluid fills the wellbore 1 from the downhole end thereof substantially up to the knuckle 12 of the liner 4. Thus, the heavy fluid will prevent the cement 222 from leaking from the annulus, while the column of heavy fluid is kept to a minimum height, to limit the hydrostatic pressure due to said column. Subsequently, the drill string and the drill bit 22 are pulled into the wellbore from surface until the drill bit has passed the knuckle 12, and the remainder of the sealing fluid 220 is flushed out using standard drilling fluid 210; and 2) Set an annular seal 232 to block the downhole end of the annulus 202 to prevent the leaking of the cement layer 222 from the annulus when the cement is not yet set.

After completing step 4, one can start over at the first step, shown in FIG. 4 and described above.

Please note that the method described above is also suitable to provide a layer of cement or other sealing fluid in the annular space around a non-everting liner pipe. If the pipe is not everted however, the pipe is forwarded into the cement. Only one predetermined length of pipe can be provided with a layer of cement, as the pipe will be fixed by the cement after setting thereof.

The length of the cement sheet 222 may be in the range of about 1 km or less, for instance a few hundred meters down to a few meters. The cementing process of the present invention is semi-continuously, and tripping of the drill string (removing and re-introducing into the bore hole) is obviated.

The sealing fluid, for instance cement, preferably has the following characteristics:

- Have a relatively low density. In practice, the Specific Gravity (SG) may be as close as possible to 1 SG. SG may be in the range of about 0.5 to 5, for instance in the order of 1 or 2 SG. SG herein is the ratio of the density (mass of a unit volume) of the sealing fluid to the density (mass of the same unit volume) of (pure) water;
- After setting, the layer 222 will be relatively flexible;
- The hardened layer 222 will seal the annulus. Sealing herein for instance implies able to withstand a differential fluid pressure along the well bore up to about 400, or up to about 1200 bar.

Alternatively to cement, the sealing fluid may comprise any other slurry material that sets after a predetermined time, or may comprise a combination of different hardening materials:

- A hardenable resin, such as disclosed above;
- A mixture of sand and clay which will be squeezed and fixed in the annulus while everting the liner 4;
- Cuttings that get trapped in the annulus while everting the liner 4.

Figure 8:
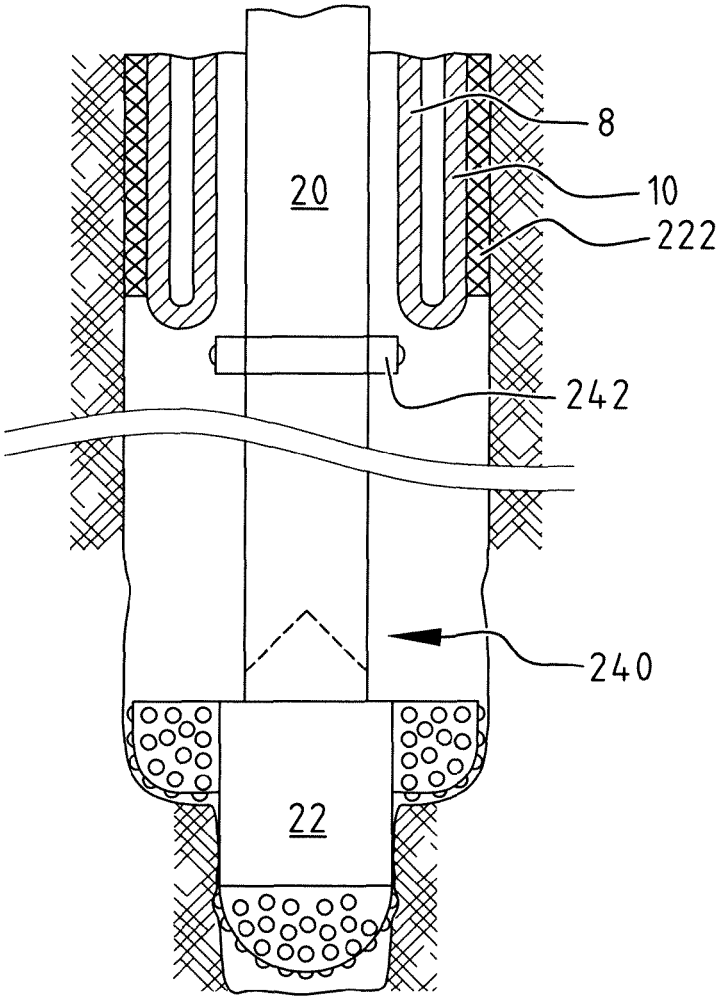
FIG. 8 shows a vertical cross section of an alternative embodiment of the invention comprising a bypass valve, shown in a closed position.

There are multiple ways to replace the drilling fluid by cement or other sealing fluid in the second step, for instance:

1. Pump the cement through the drill string 20, including optional Bottom Hole Assembly (BHA, not shown), and let the cement exit through the bit 22;

2. Pump the cement through the drill string 20, but let the cement exit through a bypass valve 240 arranged near the bit 22. The bypass valve is in closed position (FIG. 8) during drilling and moved to an open position (FIG. 9) while introducing cement into the wellbore.

Figure 9:
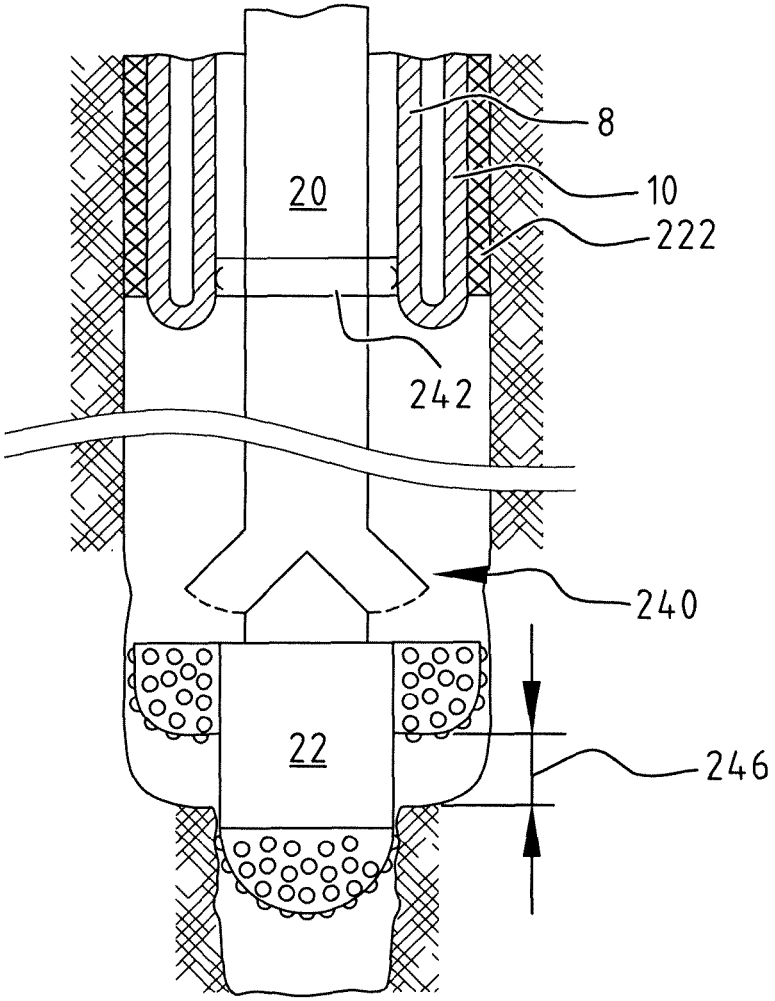
FIG. 9 shows a vertical cross section of the embodiment of FIG. 8 showing the bypass valve in an open position.
Figure 10:
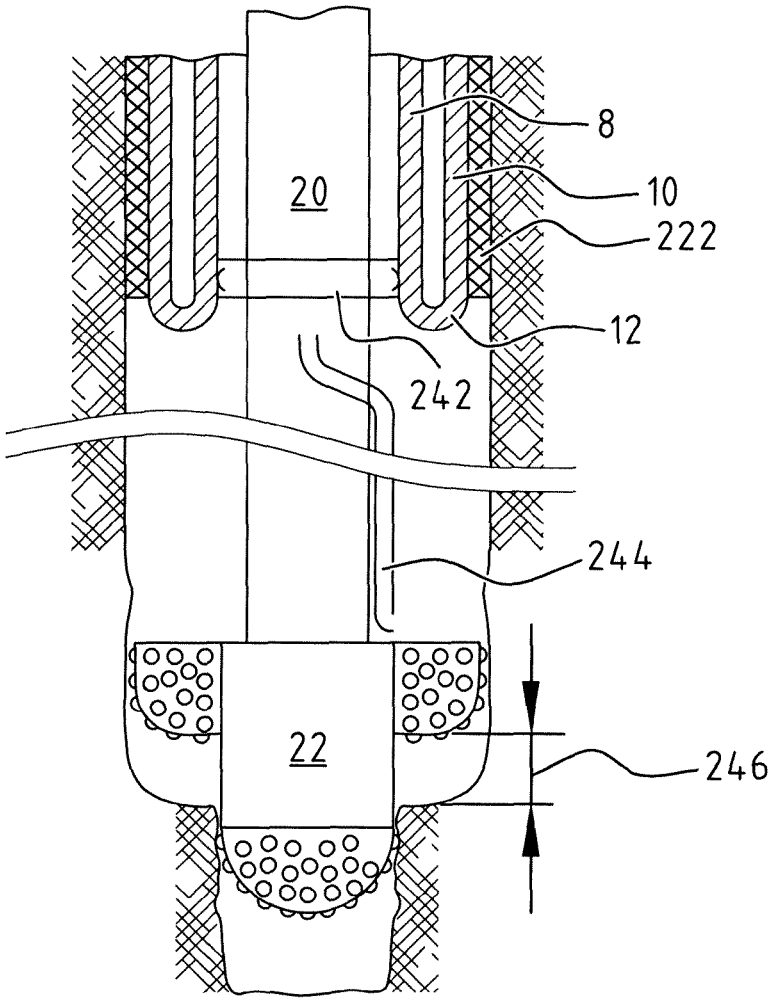
FIG. 10 shows a vertical cross section of a wellbore, indicating yet an alternative embodiment of a second step in a method according to the invention.

The valve 240 may be controlled between the closed position and the open position using a trigger mechanism 242. Said trigger mechanism can be attached to the drill string 20. The trigger mechanism can, for instance, be activated by pulling the drill string into the tubular element along a predetermined distance L2 (indicated by arrow 246), until the trigger mechanism 242 engages the inner surface of the unexpanded tubular section 8 (FIG. 9).

Alternatively, the valve may be controlled by dropping one or more trigger objects into the wellbore, each having a predetermined size, for either opening or closing the valve depending on the size of the respective trigger object. The trigger object may include for example a ball or a dart. Multiple trigger objects may be dropped to change the valve repeatedly from the opened to closed position and vice versa. Tripping the drill pipe, i.e. removing it from the wellbore and re-introducing the drill pipe, may be obviated; and 3. Using the same kind of trigger mechanism (242), the flow of cement may be diverted from the drill string 20 into a bypass tube 244, which is attached to the drill string between the bit 22 and the knuckle section 12 of the liner 4.

Options 2) and 3) may better protect equipment in the BHA (Bottom Hole Assembly) which may be sensitive to cement. Alternatively, during execution of any of the above methods, it may be beneficial to pull up the drill string 20 until the drill bit 22 is enclosed in the unexpanded liner section 8. Herein, the drill string is pulled up more than the distance indicated by the arrow 246. The reamer section 26 can be collapsed to reduce the outer diameter of the drill bit 22 to a diameter smaller than the inner diameter of the unexpanded tubular section 8.

In a practical embodiment, the diameter and/or wall thickness of the liner 4 can be selected such that the expanded liner section 10 is pressed against the wellbore wall 224 during the expansion process. The expanded liner 10 may thus seal against the wellbore wall and/or stabilize the wellbore wall.

The wall thickness of the liner 4 may be equal to or thicker than about 2 mm (0.08 inch). The wall of the liner 4 may be for instance more than 2.5 mm thick, for instance about 3 to 30 mm thick or about 3.2 to 10 mm. The outer diameter of the unexpanded section may be about 50 mm (2 inch) or more, for instance in the range of about 50 to 400 mm (16 inch). The expanded section may have any outer diameter suitable for or commonly used for hydrocarbon wellbores. The wall of the liner may comprise a relatively strong material, such as a metal or preferably steel, or may be made of solid metal or solid steel. Thus, the liner 4 can be designed to have adequate collapse strength to support a wellbore wall and/or to withstand internal or external pressures encountered when drilling for hydrocarbon reservoirs.

The length and hence the weight of the unexpanded liner section 8 will gradually increase during extension of the wellbore. Hence, the downward force exerted by the pushing device 42 can be gradually decreased in correspondence with the increasing weight of unexpanded liner section 8. As said weight increases, the downward force eventually may need to be replaced by an upward force to maintain the total force within a predetermined range. This may prevent buckling of liner section 8.

During drilling, the unexpanded liner section 8 proceeds into the wellbore while the drill string 20 also gradually proceeds into the wellbore 1. The unexpanded liner section 8 may be pushed into the wellbore at about twice the speed as the drill string 20, so that the bending zone 14 remains at a relatively short distance above the drill bit 22. Herein, said short distance indicates the length L1 of the open hole section 208 (see FIGS. 1 and 4), i.e. the unlined section, of the wellbore 1. The method of the present invention enables an open hole section having a length L1 smaller than, for instance, about 100 or smaller than 50 meters at all times while drilling the wellbore.

The unexpanded liner section 8 may be supported by the drill string 20, for example by means of a bearing device (not shown) connected to the drill string, which supports the bending zone 14. In that case the upward force is suitably applied to the drill string 20, and then transmitted to the unexpanded liner section 8 through the bearing device. Furthermore, the weight of the unexpanded liner section 8 then can be transferred to the drill string and utilised to provide a thrust force to the drill bit 22.

Drilling fluid containing drill cuttings is discharged from the wellbore 1 via outlet conduit 90. Alternatively, drilling fluid may be circulated in reverse circulation mode wherein the drilling fluid is pumped into the wellbore via the conduit 90 and discharged from the wellbore via the drill string 20.

When it is required to retrieve the drill string 20 to surface, for example when the drill bit 22 is to be replaced or when drilling of the wellbore 1 is complete, the reamer section 26 can be collapsed to its radially retracted mode, wherein the radial diameter is smaller than the internal diameter of the unexpanded liner section 8. Subsequently, the drill string 20 can be retrieved through the unexpanded liner section 8 to surface.

With the wellbore system of the invention, it is achieved that the wellbore is progressively lined with the everted liner directly above the drill bit, during the drilling process. As a result, there is only a relatively short open-hole section 208 during the drilling process at all times. Short herein may indicate a length L1 of the open hole section of less than 1 km, for instance in the range of about 10 to 300 meter. Advantages of a short open hole section include limited possibility of influx into the wellbore, which will minimize the resulting pressure increase and simplify well control. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice wherein casings of stepwise decreasing diameter must be set at selected intervals.

Also, if the wellbore is drilled through a shale layer, such short open-hole section eliminates possible problems due to a heaving tendency of the shale.

After the wellbore has been drilled to the desired depth and the drill string has been removed from the wellbore, the length of unexpanded liner section that is still present in the wellbore can be left in the wellbore or it can be cut-off from the expanded liner section and retrieved to surface.

In case the length of unexpanded liner section is left in the wellbore, there are several options for completing the wellbore. These are, for example, as outlined below.

A) A fluid, for example brine, is pumped into the blind annulus 44 between the unexpanded and expanded liner sections so as to pressurise the annulus and increase the collapse resistance of the expanded liner section 10. Optionally one or more holes are provided in the bending zone 14 to allow the pumped fluid to be circulated.

B) Cement is pumped into the blind annulus 44 in order to create, after hardening of the cement, a solid body between the unexpanded liner section 8 and the expanded liner section 10. The cement may expand upon hardening.

C) The unexpanded liner section is radially expanded (i.e. clad) against the expanded liner section, for example by pumping, pushing or pulling an expander through the unexpanded liner section.

In the above examples, expansion of the liner is started at surface or at a downhole location. In case of an offshore wellbore wherein an offshore platform is positioned above the wellbore, it may be advantageous to start the expansion process at the offshore platform, at or above the water surface. Herein, the bending zone moves from the offshore platform to the seabed and subsequently into the wellbore. Thus, the resulting expanded tubular element not only forms a liner in the wellbore, but also a riser extending from the offshore platform to the seabed. The need for a separate riser is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after completion of the eversion process, will be subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or relatively low collapse rating.

Instead of leaving a length of unexpanded liner section in the wellbore after the expansion process, the entire liner can be expanded with the method described above so that no unexpanded liner section remains in the wellbore. In such case, an elongate member, for example a pipe string, can be used to exert the necessary downward force to the unexpanded liner section during the last phase of the expansion process.

In order to reduce friction forces between the unexpanded and expanded liner sections during the expansion process, a friction reducing layer, such as a Teflon layer, may be applied between the unexpanded and expanded liner sections. For example, a friction reducing coating can be applied to the outer surface of the unexpanded section 8. The friction reducing layer reduces the force which is required to evert the liner and to push the unexpanded section into the wellbore. Thus said force is kept further below a so-called critical buckling load, which is the force at which the unexpanded liner will buckle or otherwise fail. Instead of, or in addition to, the friction reducing layer, centralizing pads and/or rollers can be applied in the blind annulus between the unexpanded and expanded sections to reduce the friction and the annular clearance.

Instead of expanding the expanded liner section against the wellbore wall (as described), the expanded liner section can be expanded against the inner surface of another tubular element, e.g. casing or a liner, already present in the wellbore.

Although the embodiments of the invention have been described including a top drive, the present invention is likewise suitable for use with alternative drilling systems. The latter may include for instance a downhole motor instead of a top drive. Said downhole motor is a drilling tool comprised in the drill string directly above the bit. Activated by pressurized drilling fluid, it causes the bit to turn while the drill string does not rotate. Examples of the downhole motor include a positive-displacement motor and a downhole turbine motor. Also, any other drilling tool may be deployed to drill the borehole. Such drilling tool may include, for instance, an abrasive jetting device suspended at the end of a pipe string.

The present invention is likewise suitable for directional drilling, i.e. drilling wherein the drilling direction can be adjusted. For instance, a downhole motor may be used as a deflection tool in directional drilling, where it is made up between the bit and a bent sub, or the housing of the motor itself may be bent.

The present invention is not limited to the above-described embodiments thereof, wherein various modifications are conceivable within the scope of the appended claims. For instance, features of respective embodiments may be combined.

The invention claimed is:

1. A method for sealing an annulus around an expanded section of an expandable tubular element in a wellbore, the expanded section of the expandable tubular section enclosing a tool string, wherein a downhole end portion of a wall of the expandable tubular element is bent radially outward and in axially reverse direction defining the expanded tubular section extending around an unexpanded tubular section of the expandable tubular element, the method comprising the steps of:

i) introducing a first drilling fluid in the wellbore;

ii) drilling an open hole section of the wellbore using a drilling tool suspended at the end of the tool string;

iii) replacing the drilling fluid with a sealing fluid;

iv) extending the tubular element into the sealing fluid in the open hole section of the wellbore, by pushing the unexpanded section into the expanded tubular section thereby creating a layer of sealing fluid in the annulus between the expanded tubular section and the wellbore;

v) flushing part of the sealing fluid out of the wellbore, leaving the annulus filled with the layer of sealing fluid.

2. The method of claim 1, comprising the step of:

vi) allowing said layer of sealing fluid to set during a setting time period.

3. The method of claim 2, comprising the step of: vii) repeating the previous steps.

4. The method of claim 1, wherein the step of flushing part of the sealing fluid comprises:

replacing the sealing fluid with a second drilling fluid, said second drilling fluid having a second specific weight exceeding a first specific weight of the sealing fluid.

5. The method of claim 4, wherein the sealing fluid is replaced with the second drilling fluid until the second drilling fluid has filled a downhole end of the wellbore up to at least a bending zone of the tubular element.

6. The method of claim 1, wherein the step of flushing part of the sealing fluid comprises:

arranging an annular seal to close a downhole end of the annulus between the tubular element and the wellbore wall to prevent leaking of the sealing fluid from the annulus when the sealing fluid has not yet set.

7. The method of claim 1, wherein the sealing fluid comprises cement slurry.

8. The method of claim 1, wherein the sealing fluid is selected from the group consisting of: mixtures of sand and clay, drill cuttings, and hardenable resin.

9. The method of claim 8, wherein the sealing fluid is selected from the hardenable resin and wherein the hardenable resin is selected from the group consisting of: organic resins, bisphenol-A-diglycidyl-ether resins, butoxymethyl-butyl-glycidyl-ether resins, bisphenol-A-epichlorohydrin resins, bisphenol-F-resins, polyepoxide resins, novolak resins, polyester resins, phenol-aldehyde resins, urea-aldehyde resins, furan resins, urethane resins, glycidyl-ether resins, epoxide resins, an elastomeric compound comprising an epoxy component, a poly-aspartic component, and/or a silicone rubber component, and combinations thereof.

10. The method of claim 1, wherein said sealing fluid has a specific gravity in the range of 0.1 to 10, wherein the specific gravity is the ratio of the density of the sealing fluid to the density of water.

11. The method of claim 1, wherein a downhole end of the tool string is provided with a bypass valve or bypass tube having a closed position and an open position, wherein in the open position the bypass valve or bypass tube provides a fluid passage from the inside of the tool string to the outside thereof.

12. The method of claim 11, wherein the tool string is provided with a control mechanism for controlling the bypass valve or bypass tube between the closed position and the open position.

13. The method of claim 12, including the step of:

pulling the tool string into the tubular element until a trigger mechanism is located within said tubular element, whereupon the control mechanism moves the bypass valve or bypass tube from the closed position to the open position.

14. The method of claim 12, including the step of:

dropping one or more trigger objects, each having a predetermined size, for either opening or closing the valve depending on the size of the respective trigger object.

* * * * *